US006109252A

United States Patent [19]

Stevens

[11] Patent Number: 6,109,252

[45] Date of Patent: Aug. 29, 2000

[54] PROJECTILE FEED SYSTEM

[76] Inventor: Simon Benjamin Stevens, Walnut Lodge, Furze Hill, London Road, Shipston-On-Stour, Warks CV36 4EP, United Kingdom

[21] Appl. No.: 09/054,185

[22] Filed: Apr. 2, 1998

[30] Foreign Application Priority Data

Apr. 5, 1997 [GB] United Kingdom ..... 9706988

[51] Int. Cl.[7] ..... F41B 11/02

[52] U.S. Cl. ..... 124/51.1; 124/48

[58] Field of Search ..... 124/48, 49, 51.1, 124/56, 73, 74, 72

[56] References Cited

U.S. PATENT DOCUMENTS

| | | | |
|---|---|---|---|
| 4,454,971 | 6/1984 | Poehlmann | 224/196 |
| 4,487,103 | 12/1984 | Atchisson | 89/33.02 |
| 5,335,579 | 8/1994 | David | 89/34 |
| 5,722,383 | 3/1998 | Tippmann, Sr. | 124/76 |
| 5,816,232 | 10/1998 | Bell | 124/51.1 |

FOREIGN PATENT DOCUMENTS

| | | |
|---|---|---|
| 433389 | 8/1935 | United Kingdom . |
| 685700 | 1/1953 | United Kingdom . |
| 2 024 786 | 1/1980 | United Kingdom . |

*Primary Examiner*—John A. Ricci
*Attorney, Agent, or Firm*—Jones & Askew

[57] ABSTRACT

Apparatus for feeding of paint balls to the breech of a paint ball gun. Paint balls are received in pockets around the periphery of a carrier. Rotation of the carrier moves the paint balls into contact with a guide assembly. The guide assembly, which comprises a guide bar and a squash plate, move the paint balls from the pockets and into an outlet of the apparatus. In a preferred embodiment, a guide disc is mounted above the carrier, the guide disc having a plurality of guide openings which are aligned above the pockets.

62 Claims, 18 Drawing Sheets

16
4
6
32
22
30
46
28
42
50
50
42
E
D
C
B
A
E
D
C
B
A
60
10
18

PROJECTILE FEED SYSTEM

The present invention relates to a feed system for the storage, handling and delivery to a specified location of spherical objects and in particular, though not exclusively to a feed system for the supply of paint ball capsules to a paint ball gun.

The sport of paint balling is becoming increasingly popular and utilises hand held apparatus to project paint balls at a target. The paint balls themselves comprise a quantity of liquid paint encased within a frangible shell. In use the paint ball is projected with sufficient force that, upon impact, the shell breaks and the target is marked with the liquid paint. The apparatus or gun typically has the appearance of a firearm having a barrel, a stock and a breech mechanism operable by a trigger. The guns differ from a conventional firearms in that the energy to project the paint balls from the barrel is supplied by a compressed gas, typically air, as opposed to an explosive charge associated with each projectile. The compressed gas is used reciprocate components of the breech mechanism which in turn accelerate paint balls fed sequentially into the breech mechanism. Typically paint balls are fed by gravity to the breech mechanism from a hopper which projects above the gun.

The use of a hopper which projects above the gun is disadvantageous as it presents a prominent target which can be fired upon by a competitor. Furthermore the guns have been developed to such an extent that the breech mechanism can reciprocate faster than the paint balls can be fed into the breech by gravity. Consequently the rate of fire of the gun is limited to the paint ball feed rate. Problems also exist in synchronising the operation of the breech mechanism with the feed or projective thereto. If the breech mechanism is operated when a paint ball is only partially located within the breech, the paint ball may be ruptured and subsequently lead to the gun becoming jammed. Conventional feed systems are configured such that it is possible, while containing a plurality of paint balls, they may fail to deliver one to the breech. Consequently there may not be a paint ball in the breech when the breech mechanism is operated and thus the gas used to reciprocate the breech mechanism is wasted.

According to a first aspect of the invention there is provided apparatus comprising a chamber having an inlet and an outlet, a carrier mounted in the chamber, the carrier being contoured so as to define a plurality of pockets around its periphery and each pocket being capable of receiving a single spherical object, the apparatus further comprising guide means to urge respective spherical objects from the pockets and into the outlet as a result of relative rotary movement between the carrier and the guide means.

Preferably the carrier is mounted in the chamber for rotation by drive means relative to the guide means.

in a preferred embodiment the outlet is positioned substantially tangentially with respect to the carrier. Preferably also the guide means to urge the spherical objects from the pockets comprises a guide bar positioned adjacent the carrier and adjacent the outlet. The guide means may also include a guide member such as a plate surmounting the guide bar. Preferably the guide bar includes a curved guiding surface which extends form a position in which it can make contact with a spherical object in one of the pockets, to a position where it guides the spherical object into the outlet. In one embodiment the guiding surface may include a recess which is of the same radius of curvature as the outer surface of a paint ball. In such an embodiment the recess preferably extends from the position in which the guiding surface makes contact with a spherical object in one of the pockets, to a position where it guides the spherical object into the outlet.

The drive means may comprise a motor which can be driven by electrical, mechanical, pneumatic or hydraulic means. In an alternative embodiment the drive means may comprise a reciprocating arrangement such as a piston and a ratchet mechanism. Where such a mechanism is used, the piston may be reciprocated by electrical, pneumatic or hydraulic means. The electrical means may take the form of a solenoid. The pneumatic means may comprise an air motor. The drive means may be reversible in order to assist in the clearing of gun jam situations.

In a preferred embodiment, the apparatus is adapted to deliver spherical objects in the form of paint balls to a paint ball gun. Preferably the paint balls are delivered from the outlet of the apparatus to the breech mechanism of the gun via a tube or hose. It will thus be understood that paint balls introduced into the outlet by relative rotation between the carrier and guide means will urge forwards and subsequently advance paint balls already in the tube or hose. Preferably the carrier rotates relative to the guide means. In an alternative embodiment the apparatus may be adapted to replenish or refill a receptacle or existing paint ball feed system carried by a paint ball gun. Preferably the drive means are powered separately from the paint ball gun.

In a preferred embodiment the pockets are at least partially contoured so sa to conform to the shape of the paint balls. Thus loads transferred to the paint balls by the carrier during relative rotation are spread over a portion of the surface of the paint ball. The pockets may be arranged in a radial array in the carrier if desired. In a preferred embodiment the apparatus includes an alignment member which is located above the carrier by, for example, a spacer member. The alignment member may include a plurality of guide openings such as recesses which are aligned above the pockets of the carrier. Alternatively the alignment member may be positioned such that the guide openings are not positioned directly above the pockets, but are provided slightly ahead of the pockets in the direction of rotation. This arrangement is of particular use if the carrier and alignment member are to be rotated at high speed as it is able to accommodate the deceleration of the paint balls as they pass from the guide openings to the pockets. In such embodiments the guide means is provided between the carrier and the alignment member.

The guide member preferably serves both to guide paint balls being urged form the pockets to the outlet and to prevent paint balls entering vacant pockets immediately ahead of the guide bar. The chamber may be provided with baffles or the like to assist in the movement of paint balls into the pockets and/or the alignment member openings. The apparatus preferably has non-return means, such as a sprung gate, to prevent paint balls already within the tube or hose from returning to the apparatus. The apparatus may be operable so as to maintain a constant pressure urging the paint balls through the tube or hose irrespective of the condition of the breech mechanism.

According to a second aspect of the present invention there is provided means to control the firing action of a paint ball gun having a breech and a trigger mechanism comprising means for sensing the presence of a paint ball within the breech of the gun, means for sensing the position of the trigger mechanism of the gun, and control means to prevent the firing of the gun by the trigger mechanism unless a paint ball is correctly positioned in the breech.

Control means of the type described above will conserve the compressed gas used to power the gun by preventing the breech mechanism from operating if the breech is empty. Furthermore the likelihood of the breech mechanism operating when the a paint ball is only partially loaded, and hence rupturing the paint ball, is reduced.

The means for sensing the presence of a paint ball within the breech may comprise a micro switch. The means for sensing the condition of the trigger mechanism may comprise a micro switch. Alternatively the means for sensing the presence of a paint ball within the breech and the condition of the trigger mechanism may comprise an optical, electrical, mechanical, pneumatic, or hydraulic sensor, an infra red sensor or like sensor means.

Control means as described above can be associated with apparatus according the first aspect of the present invention. The apparatus can thus be operated to ensure that a paint ball is introduced into the breech when the breech sensor senses that the breech is empty.

Embodiments of the present invention will now be described with reference to the accompanying drawings in which.

Figure 1:
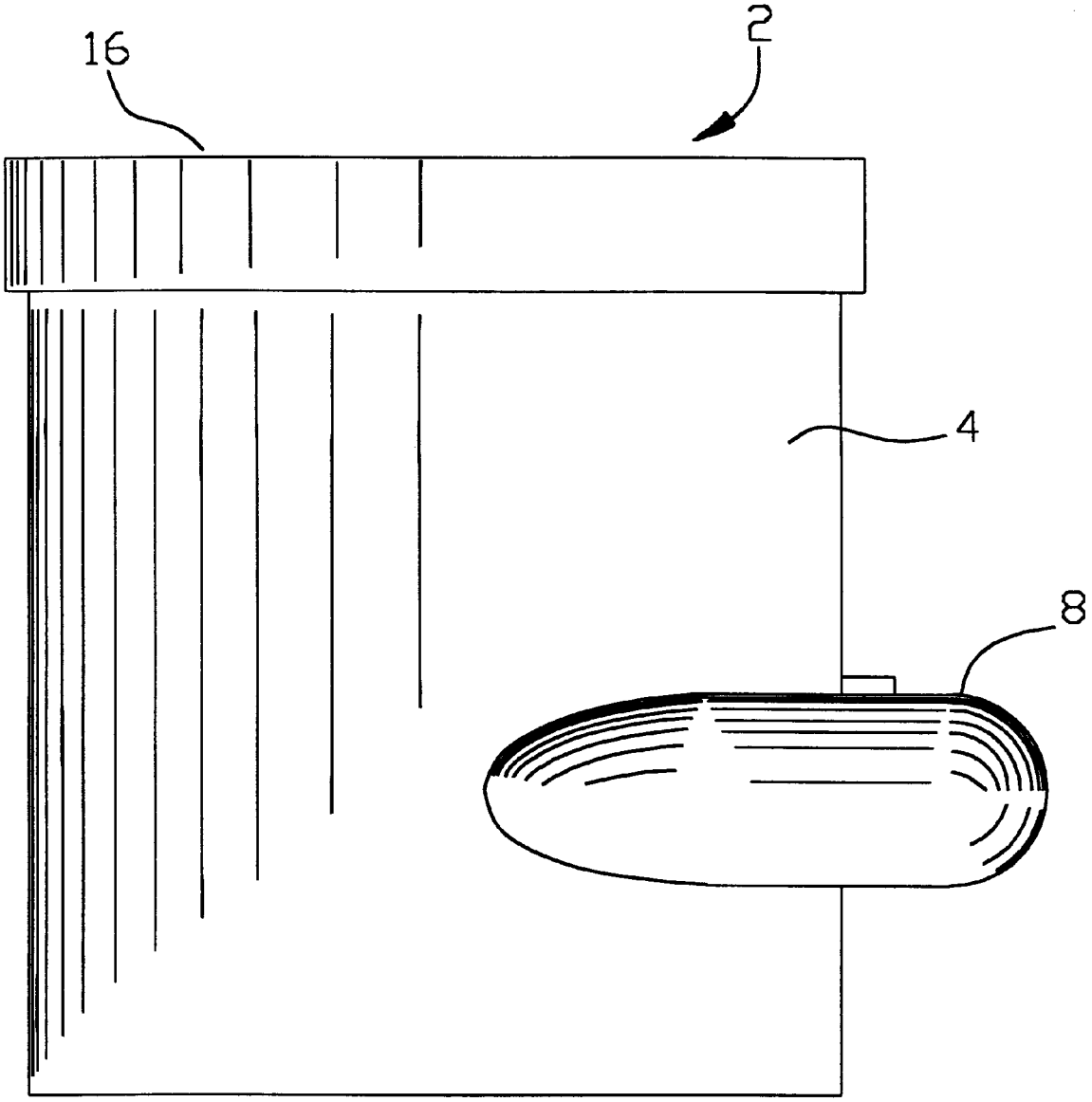
FIG. 1 shows an external side view of apparatus according to an aspect of the present invention.
Figure 2:
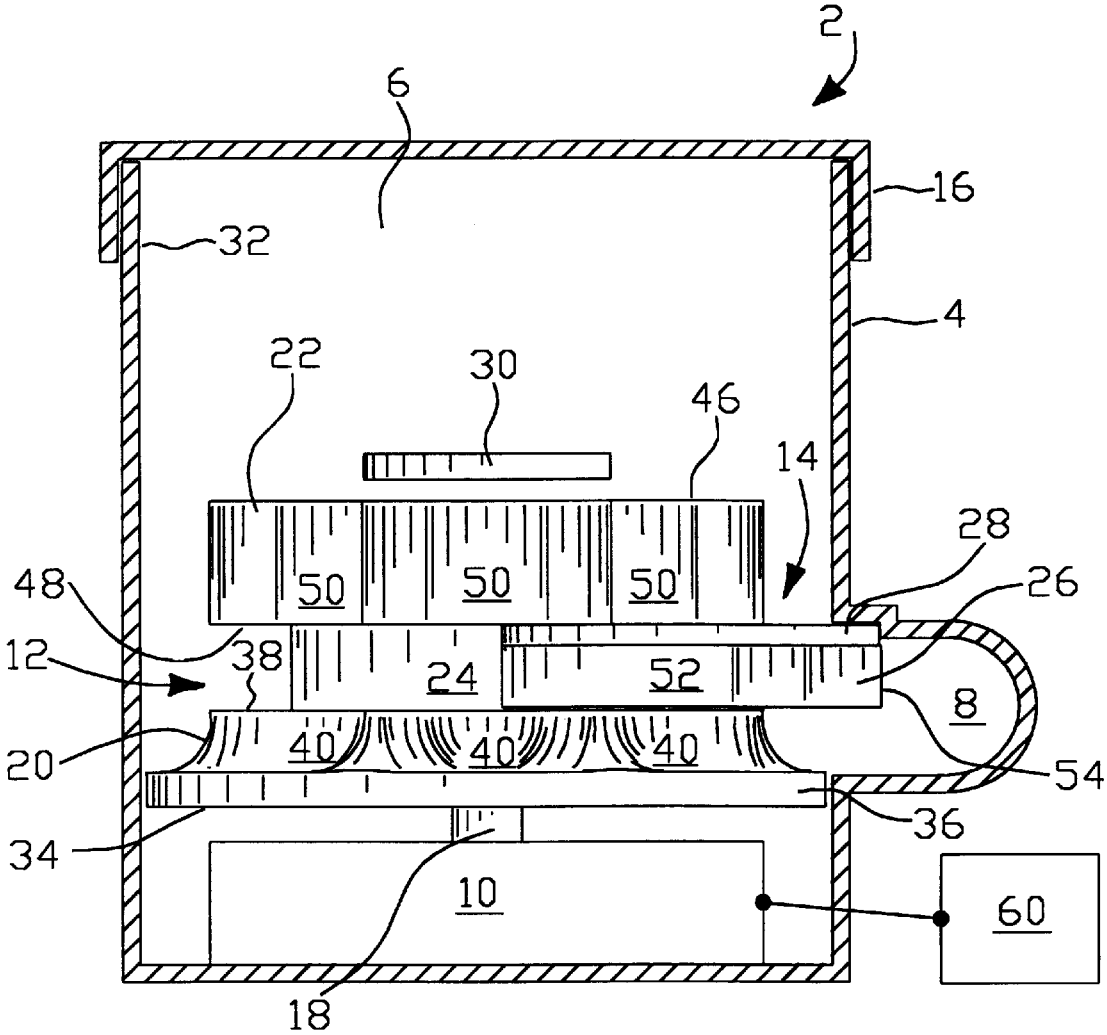
FIG. 2 is a vertical cross-section through a casing of the apparatus of FIG. 1 showing its internal mechanism.

Referring firstly to FIGS. 1 to 13 there is shown an apparatus 2 according to the present invention comprising a generally cylindrical casing 4 having an inlet 6 and an outlet 8, drive means comprising a motor 10 and a power source 60, a rotor assembly 12 and a guide assembly 14. The inlet 6 to the casing 4 has a removable lid 16. The rotor assembly 12 is attached to a driving spindle 18 extending from the motor 10 and comprises a carrier disc 20 and a guide disc 22. The carrier and guide discs 20,22 are held apart form one another by a spacer member 24. The guide assembly 14 comprises a guide bar 26 and a squash plate 28. A barrier plate 30 extends from an inner wall 32 of the casing 4. In use the rotor assembly 12 is rotatable by the motor 10 while the guide assembly 14 is anchored at a fixed position within the casing 4.

Figure 10:
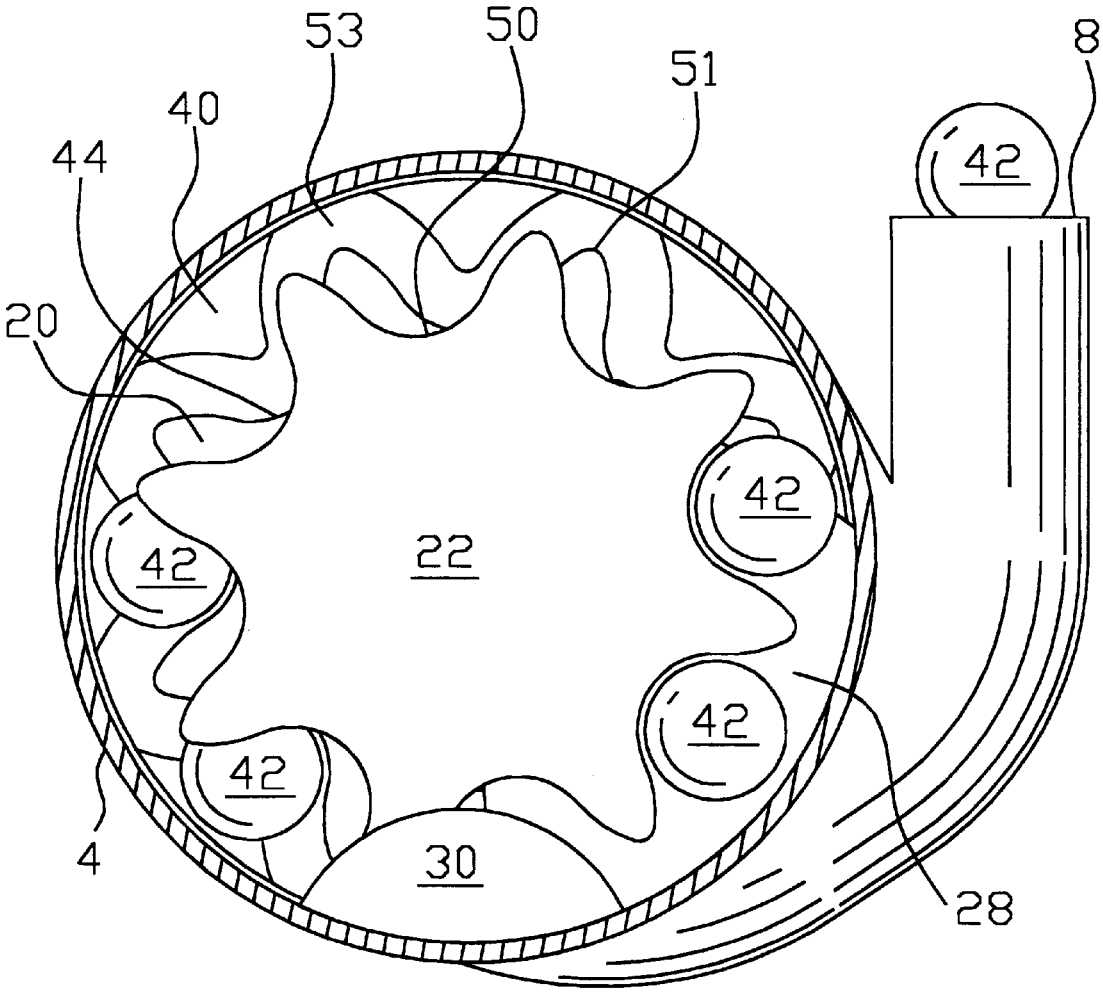
FIG. 10 shows a cross-sectional view of an apparatus having an alternative alignment member configuration, the cross-section being take at the same position shown in FIG. 9.
Figure 11:
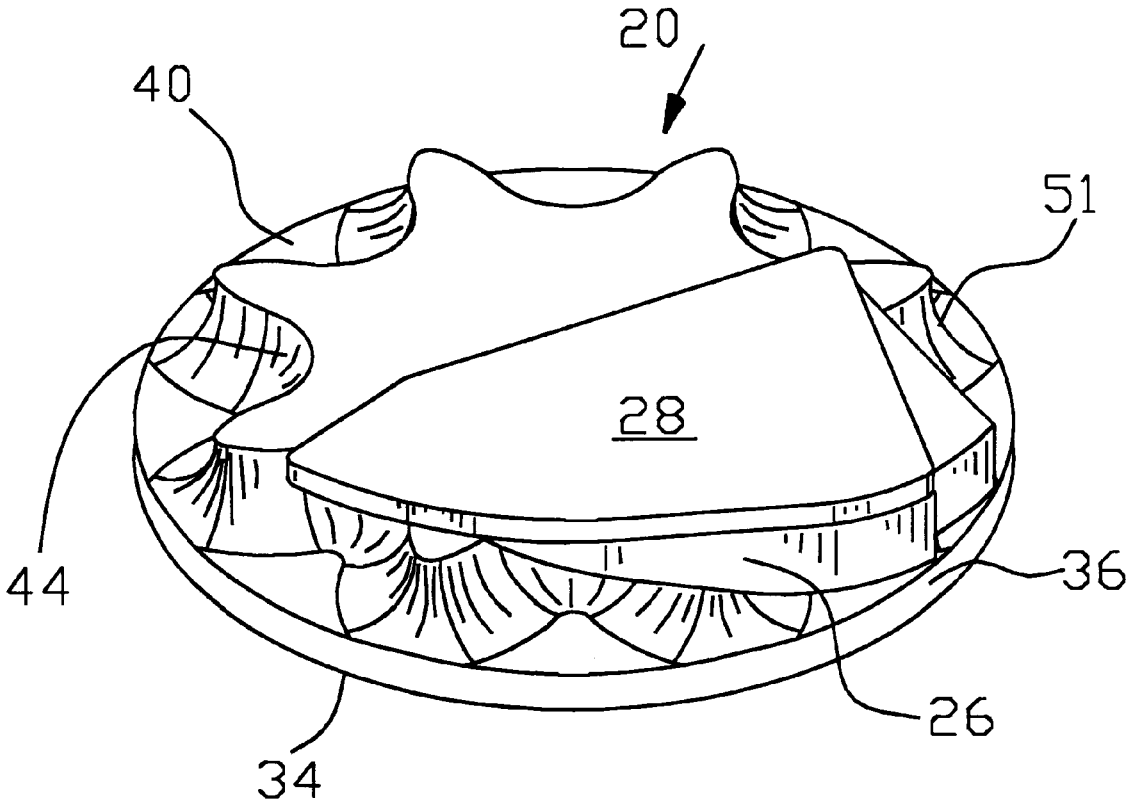
FIG. 11 is a perspective view of part of a rotor assembly of the apparatus according to the present invention.
Figure 12:
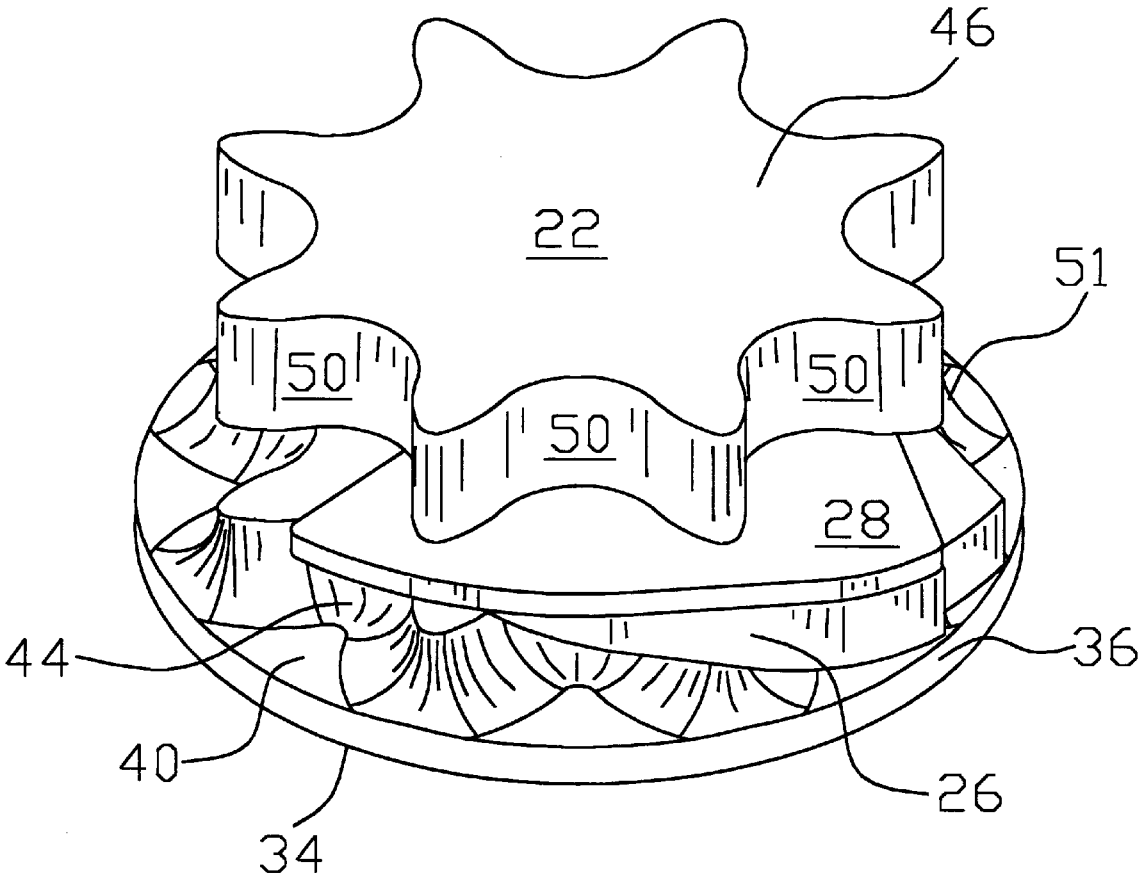
FIG. 12 is a perspective view showing the complete rotor assembly of the apparatus according to the present invention.
Figure 13:
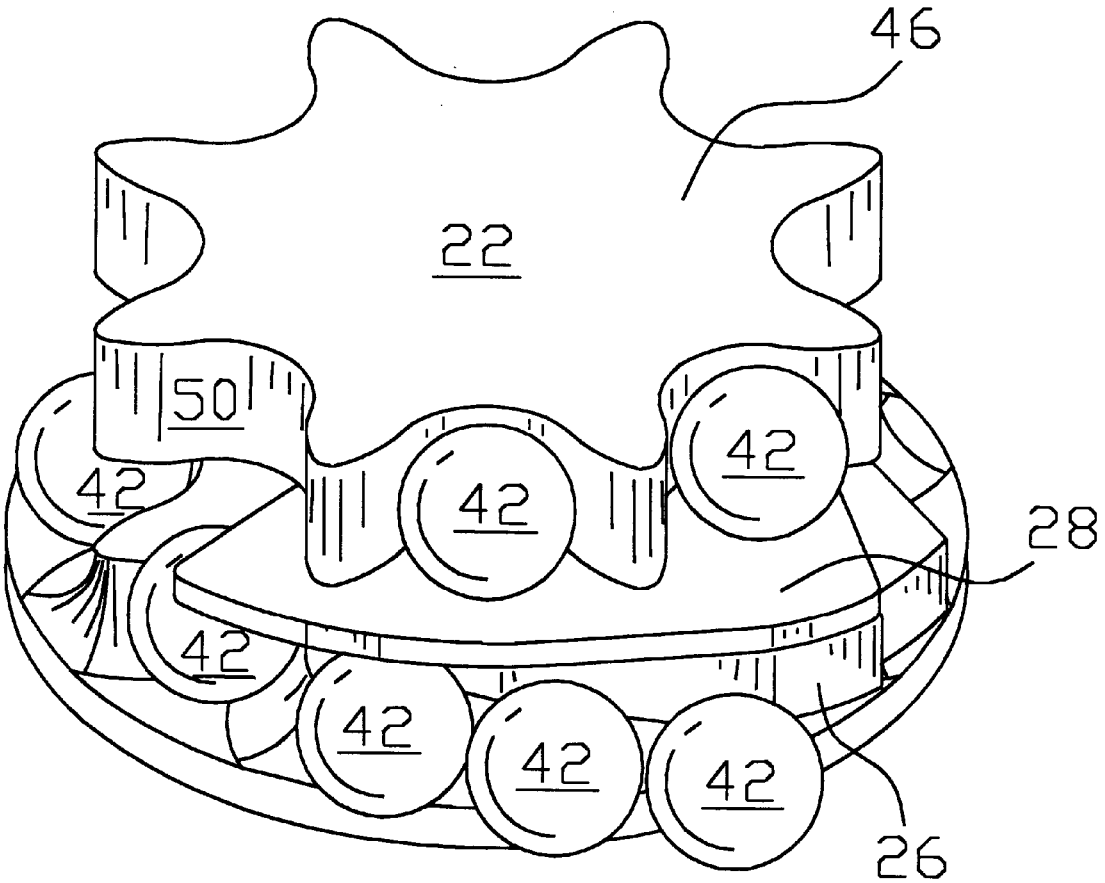
FIG. 13 shows the rotor assembly of FIG. 12 together with paint balls present in pockets adjacent a guide means.

The carrier disc 20 has a circular flat lower surface 34 and a generally circular lower portion 36. Around the periphery of the carrier disc 20, between the lower portion 36 and its upper surface 38 is formed with a plurality of equidistantly spaced pockets 40. Each pocket faces radially outwards of the carrier disc 20 and is shaped to receive a paint ball 42. In the embodiment, shown the carrier disc 20 has eight pockets 40. A rear portion 44 of each pocket 40 (see FIGS. 5 and 6) has the same radius of curvature as the outer surface of a paint ball 42. The guide disc 22 has an upper surface 46 and a lower surface 48 and, when viewed in plan (see FIG. 8), has the same shape as the upper surface 38 of the carrier disc 20. The guide disc 22 is thus provided with eight guide recesses 50. The guide disc 22 is positioned relative to the carrier disc 20 by the spacer member 24 such that the guide recesses 50 are aligned with the pockets 40. An alternative embodiment is shown in FIG. 10 wherein the guide recesses 50 are not aligned directly above the pockets 40 but are advanced in the direction of rotation. This configuration is of particular use if the rotor assembly 12, in use, is to be rotated at very high speeds, and takes into account the inertia of the paint balls 42 and their deceleration as they pass from the guide recess 50 to the pockets 40. Typically the guide disc 22 may be off set 10 degrees with respect to the carrier disc 20.

Radially extreme edges 51 of each pocket 40 curve upwardly and rearwardly from the lower portion such that a space 53 (see FIGS. 5 and 6) is defined, in use, between the pocket edges 51 and the casing 4. It will be understood that the radial dimension of the space 53 is less than the diameter of the paint balls 42 to prevent them from moving between pockets 40 in use, or becoming jammed between the pocket edges 51 and the casing 4.

The guide bar 26 and squash plate 30 are positioned adjacent the outlet 8 and between the carrier and guide discs 20,22. The guide bar 26 has a curved guide surface 52 having a distal end 54 which extends into the outlet 8. The proximal end 56 of the guide surface 52 is provided in the space between the carrier and guide discs 20,22 so as to lie approximately at a radius R at which the radially innermost edge of the pockets 40 lie. The squash plate 28 is mounted on top of the guide bar 26 and has a curved edge 58 which corresponds to the shape of the casing 4 adjacent the squash plate 28 (see FIG. 8).

Figure 3:
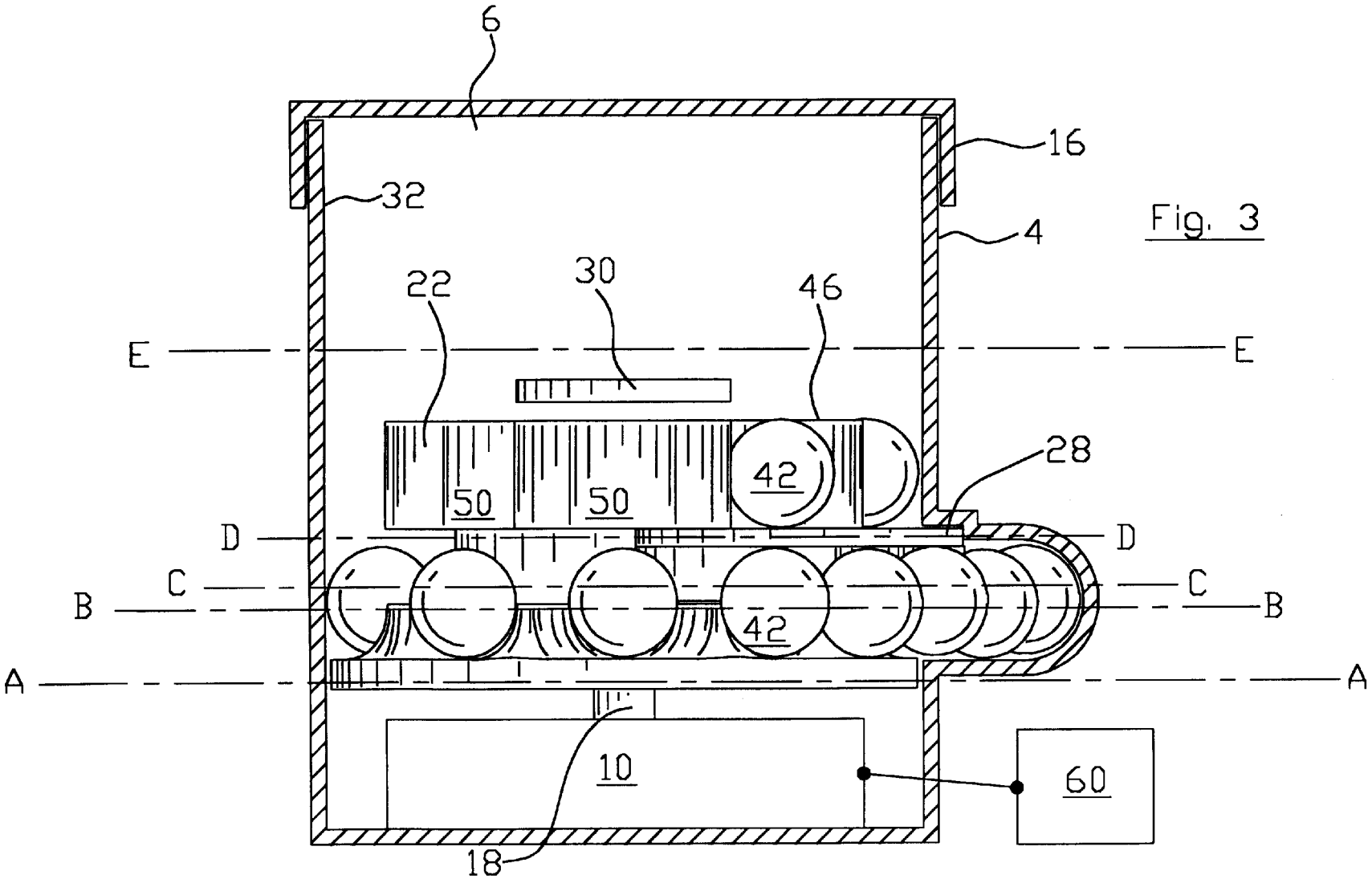
FIG. 3 shows a view similar to FIG. 2 showing the positions adopted by paint balls contained within the apparatus.
Figure 4:
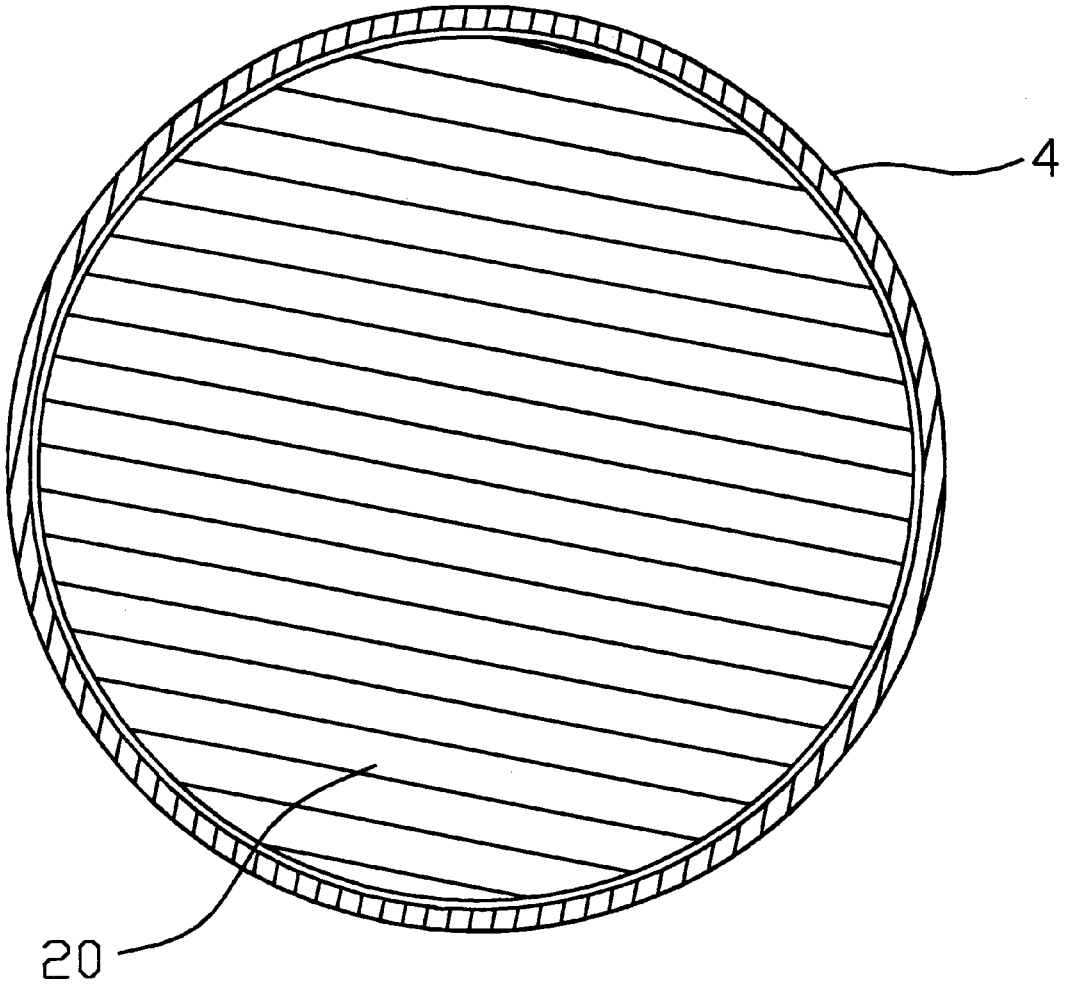
FIG. 4 shows the cross-sectional view of the apparatus indicated by A—A on FIG. 3.
Figure 5:
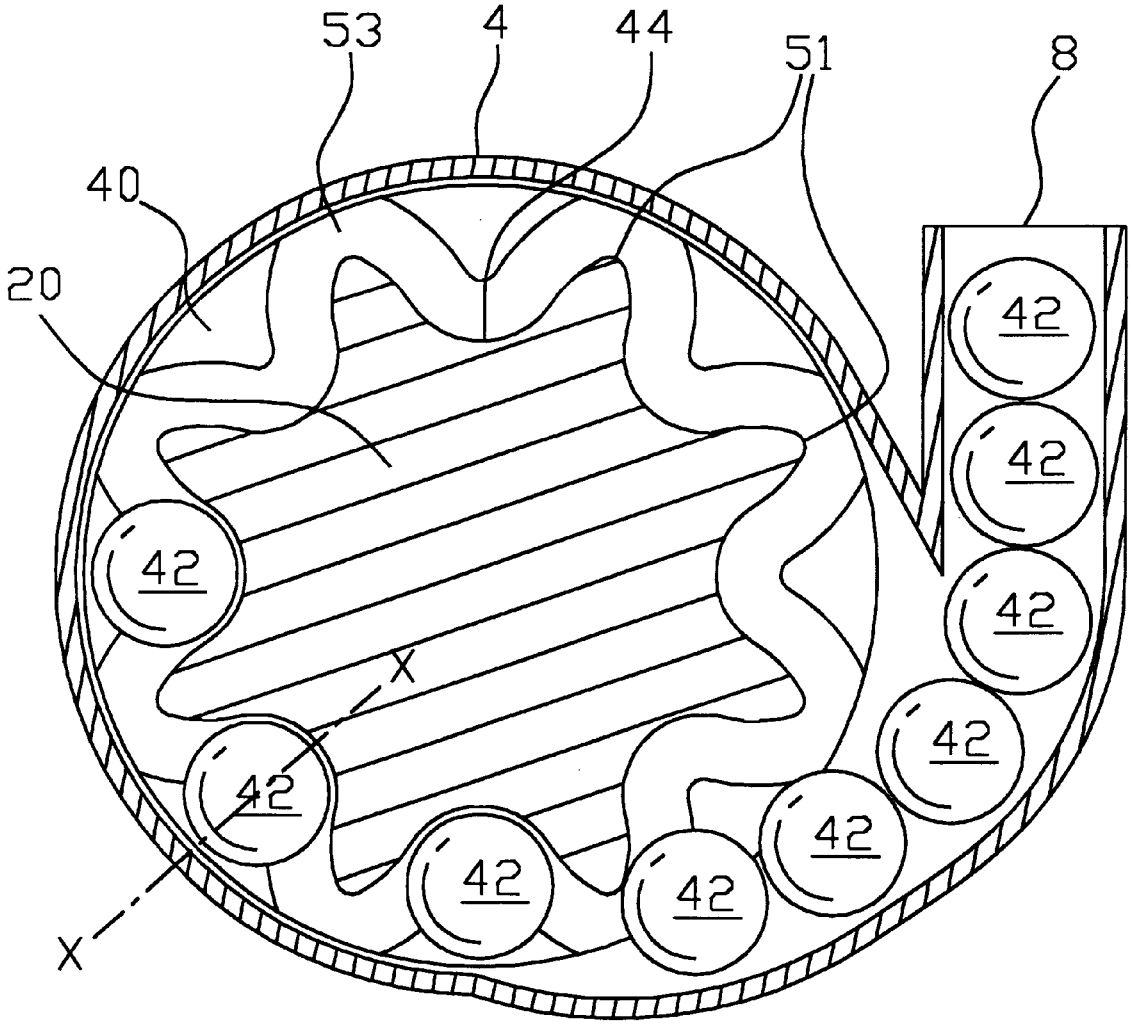
FIG. 5 shows the cross-sectional view of the apparatus indicated by B—B on FIG. 3.
Figure 6:
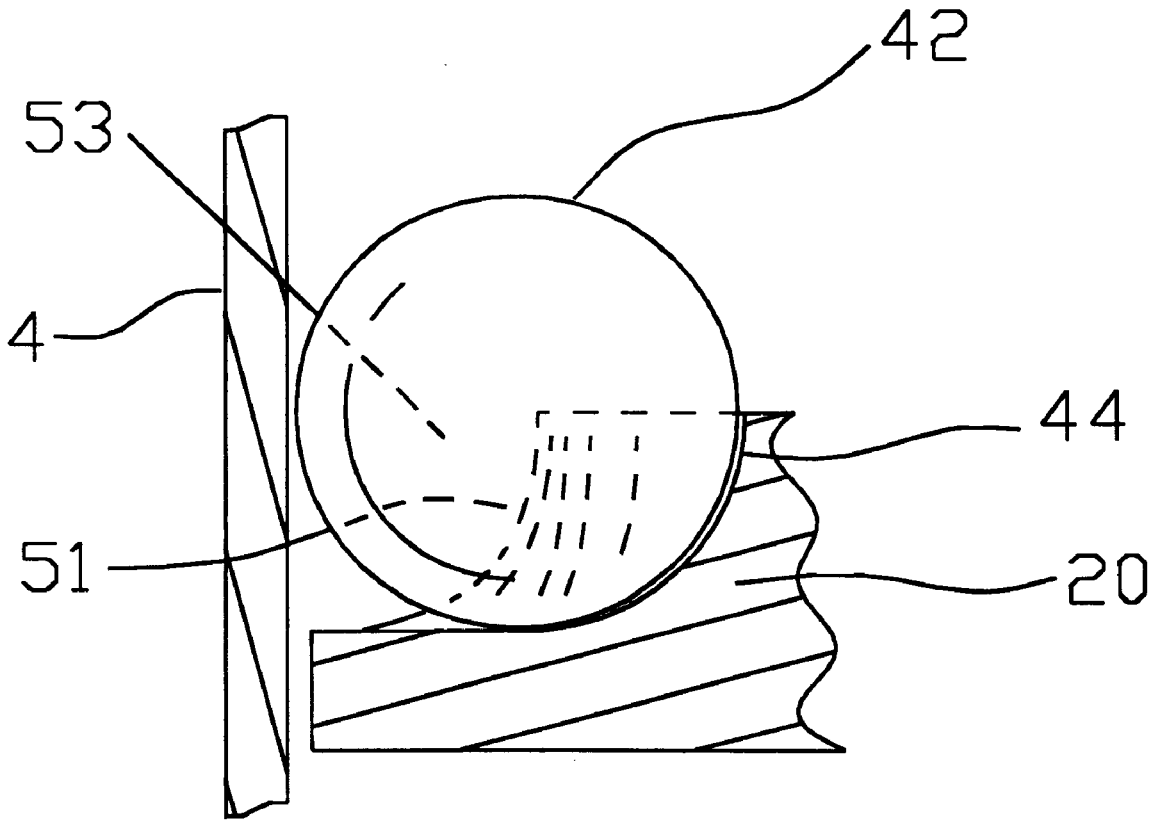
FIG. 6 is a cross-section of a part of a carrier disc of the apparatus indicated by X—X in FIG. 5.
Figure 7:
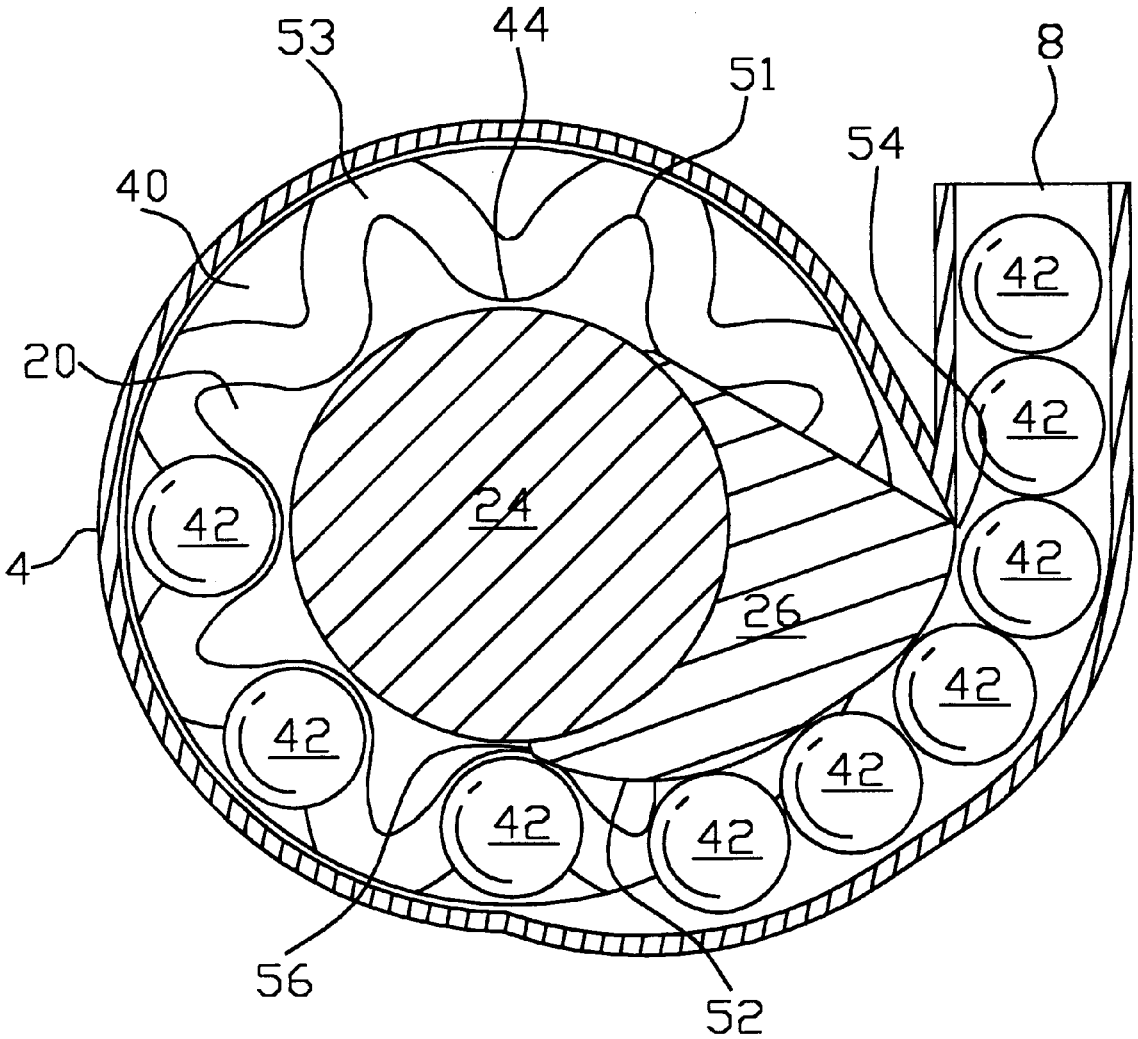
FIG. 7 shows the cross-sectional view of the apparatus indicated by C—C on FIG. 3.
Figure 8:
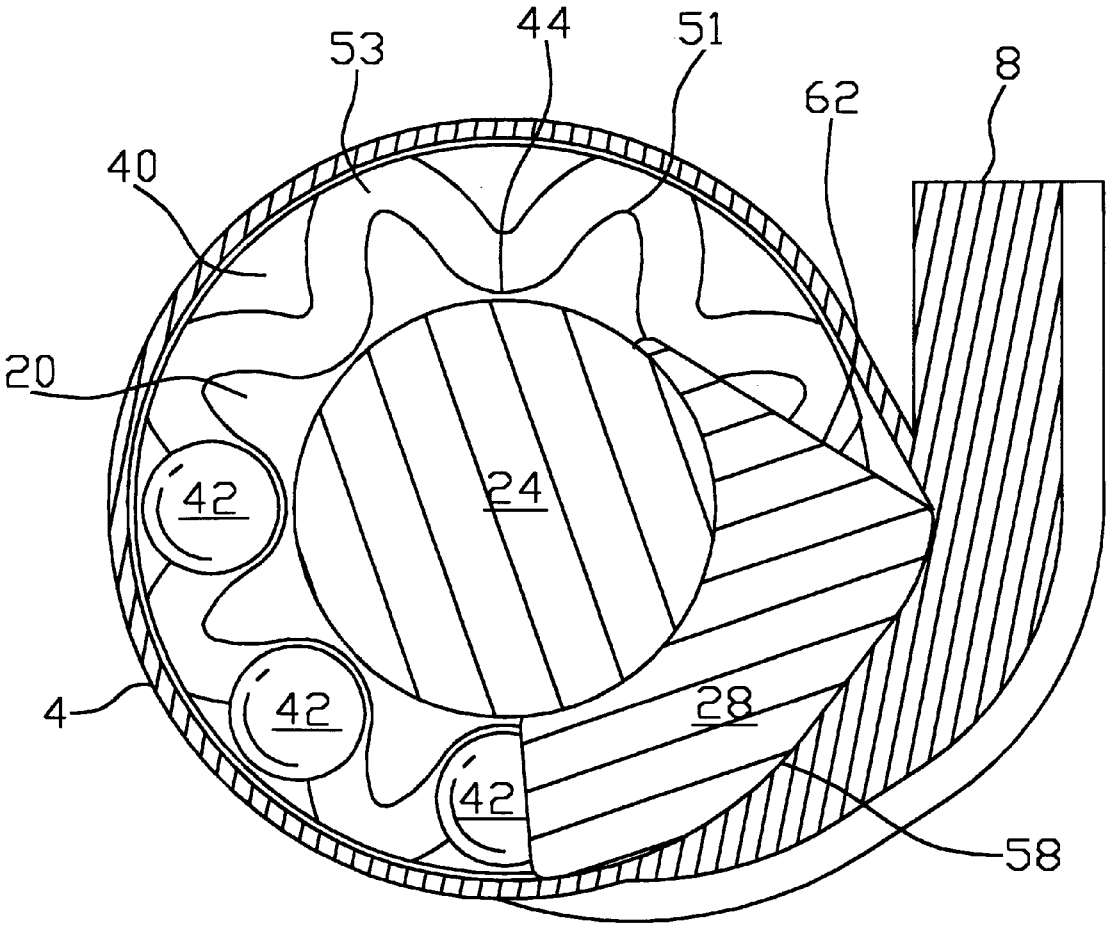
FIG. 8 shows the cross-sectional view of the apparatus indicated by D—D on FIG. 3.
Figure 9:
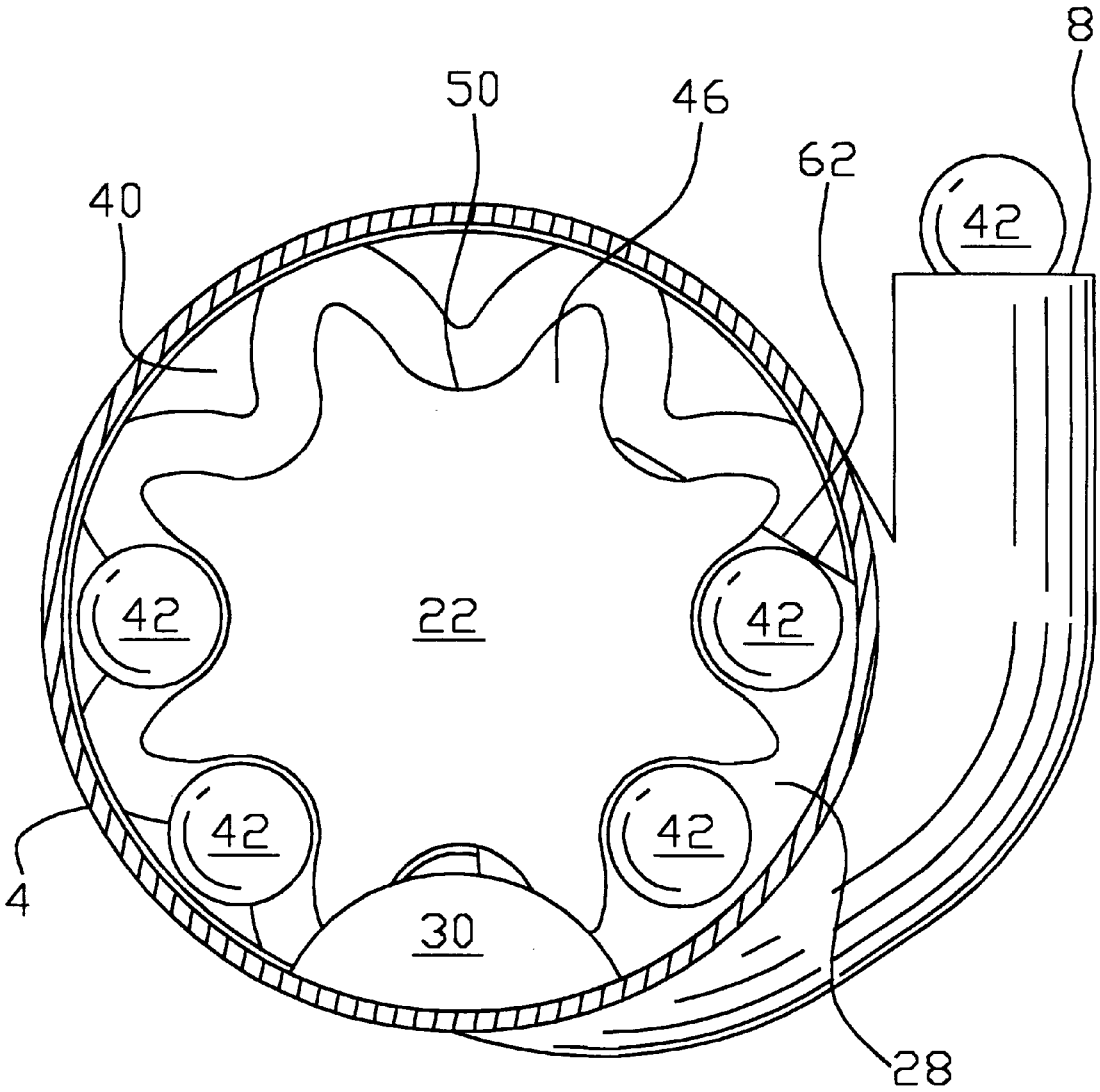
FIG. 9 shows the cross-sectional view of the apparatus indicated by E—E on FIG. 3.

In use, a plurality of paint balls 42 is introduced into the casing 4 via the inlet 6 as can be seen in FIG. 3. Under the influence of gravity the lowermost paint balls 42 are received into the pockets 40. The remaining paint balls 42 are either stacked above the pockets 40 in spaces defined between the guide disc recesses 50 and the casing 4, or remain above the guide disc 22 in readiness to descend through a recess 50 to a pocket 40. The rotor assembly 12, and any paint balls 42 retained thereby, is rotatably by the motor 10. Taking the example of a single paint ball 42 retained in a pocket 40, as the carrier disc 20 rotates the paint ball 42 is moved into contact with the guide bar 26. Continued rotation of the carrier disc 20 results in the paint ball 42, moving out of the pocket 40 and along the guide surface 52 and into the outlet 8, the guide surface 52 acting as a cam and the paint ball 42 as a follower. The cam action can be seen from FIGS. 7 and 13. The empty pocket 40 then passes below the guide assembly 14 and emerges from a rear edge 62 of the squash plate 28 ready to receive another paint ball 42 held in alignment above the pocket 40 by the guide disc 22. The squash plate 28 restricts vertical movement of the paint ball 42 as it moves into contact with the guide bar 26. Excessive vertical movement of the paint ball 42 could lead to it being misaligned and subsequently ruptured which, in turn, could lead to the apparatus becoming jammed. The squash plate 28 further serves to prevent paint balls 42 entering a vacant pocket 40 immediately ahead of the guide bar 26. This again could lead to a misaligned paint ball 42 causing a jam of the apparatus. If desired the guide disc 22 can be omitted along with the spacer 24 leaving the carrier disc 20 as shown in FIG. 9. With that arrangement the paint balls 42 need to locate directly in the pockets 40 without the advantage of the guide disc 22 assisting alignment.

Figure 14:
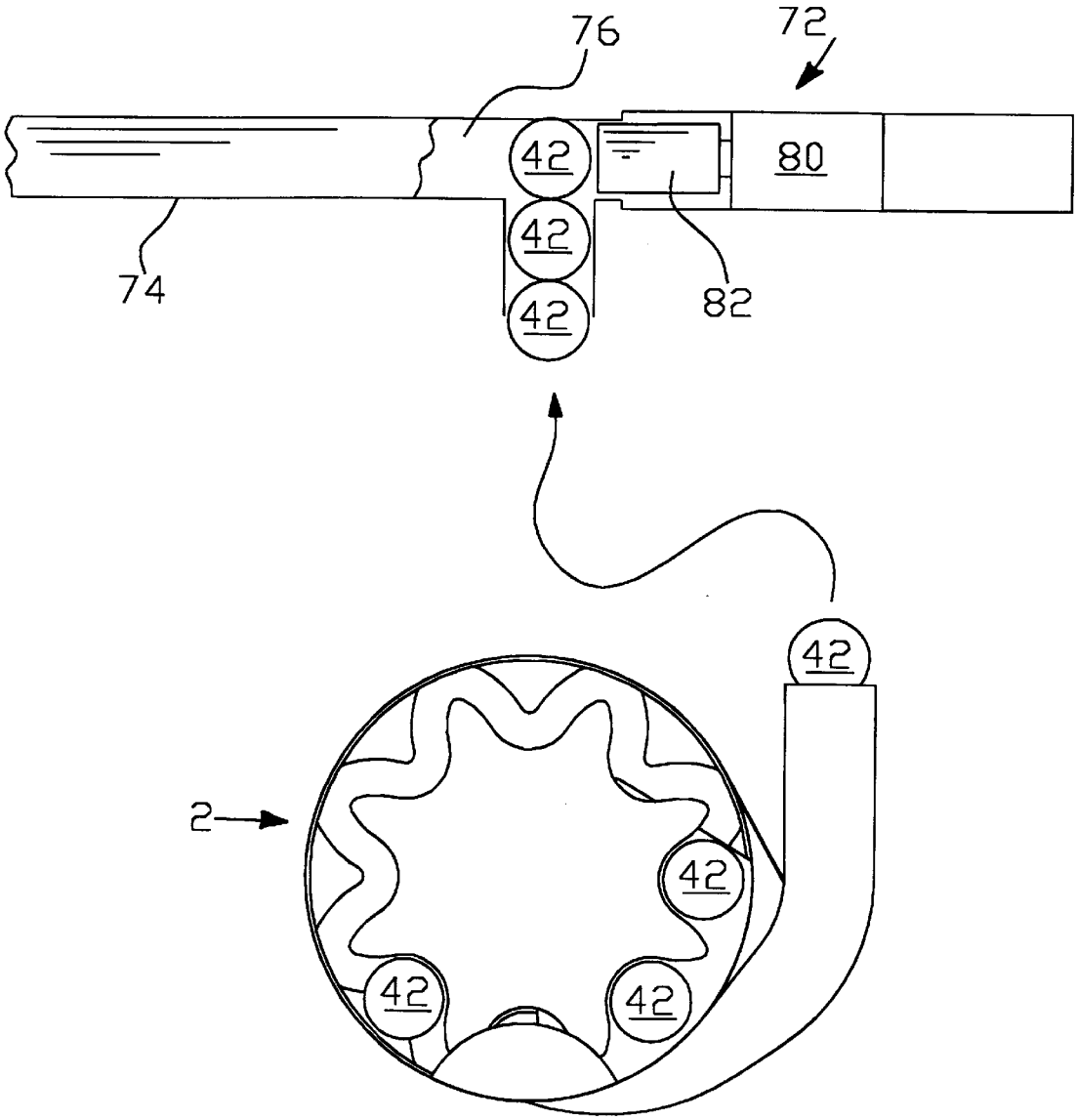
FIG. 14 shows a diagrammatic representation of apparatus according to the present invention feeding paint balls to the breech mechanism of a paint ball gun.

Referring now to FIG. 14 there is shown a diagrammatic representation of an apparatus 2 according to the present invention feeding paint balls 42 to a paint ball gun 72. The gun 72 comprises a barrel 74, a breech 76 having an inlet port 78 and a firing mechanism 80 of known kind. The firing mechanism 80 includes a movable bolt 82 which, in use, accelerates the paint balls 42 through the barrel 74. Rotation of the rotor assembly 12 as described above results in paint balls 42 being fed to the outlet 8. A duct such as a hose or tube then conveys the paint balls 42 to the inlet port 78 and into the breech 76. If the firing mechanism 80 is activated, paint balls 42 will be sequentially accelerated down the barrel 74. Provided that a sufficient number of paint balls 42 are present within the apparatus 2 they will continue to be fed to the inlet port 78. If the firing mechanism is not activated, then the apparatus 2 is able to fill the tube or hose with paint balls 42 ready for the next firing event.

Typically the apparatus 2 will be operated as follows. The rotor assembly 12 is initially rotated to fill the tube or hose with paint balls 42. The number of rotations required to accomplish this will depend on such factors as the length of the tube or hose and the number of pockets on the carrier disc 20. Once the tube or hose is filled, the gun 72 is in effect primed and ready to fire. The tube or hose may be filled by means of a button on the casing 4 which, when depressed, causes the rotor assembly to rotate and to feed paint balls 42 out of the outlet 8 and into the tube or hose. Subsequent rotation of the rotor assembly 12 is carried out in combination with a control system linked to a trigger mechanism of the gun 72. Typically this control mechanism will include a sensor linked to movement of the trigger mechanism, and means to activate the motor 10 for a specified period of time. Typically this period of time is greater than the time take for the firing mechanism 80 to complete a single firing cycle, the period of time commencing before the firing mechanism 80 operates and finishing after the firing mechanism 80 has operated. As the trigger mechanism is depressed, but before the firing mechanism 80 is activated, the movement of the trigger is sensed and the motor 10 is activated. This has the effect of imparting a force and slightly compressing the paint balls 42 in the tube or hose. Continued movement of the trigger results in the firing mechanism 80 operating and accelerating a paint ball in the breech 76 through the barrel 78. As the bolt 82 retreats from the breech 76, the force imparted by the rotor assembly 12 on the paint balls 42 in the tube or hose advances the foremost paint ball 42 into the vacant breech 76. The remaining paint balls in the tube or hose are advanced a distance approximately equal to the diameter of a single paint ball by the introduction of a paint ball 42 into tube or hose by the rotor assembly 12.

Typically the rotor assembly 12 is rotatable at a speed of approximately 240 revolutions per minute. It will be understood that the rotor assembly 12 will rotate freely when initially filling the tube or hose with paint balls 42. During firing of the gun 72 the rotor assembly 12 moves incrementally at a speed related to the operation of the firing mechanism 80.

Figure 15:
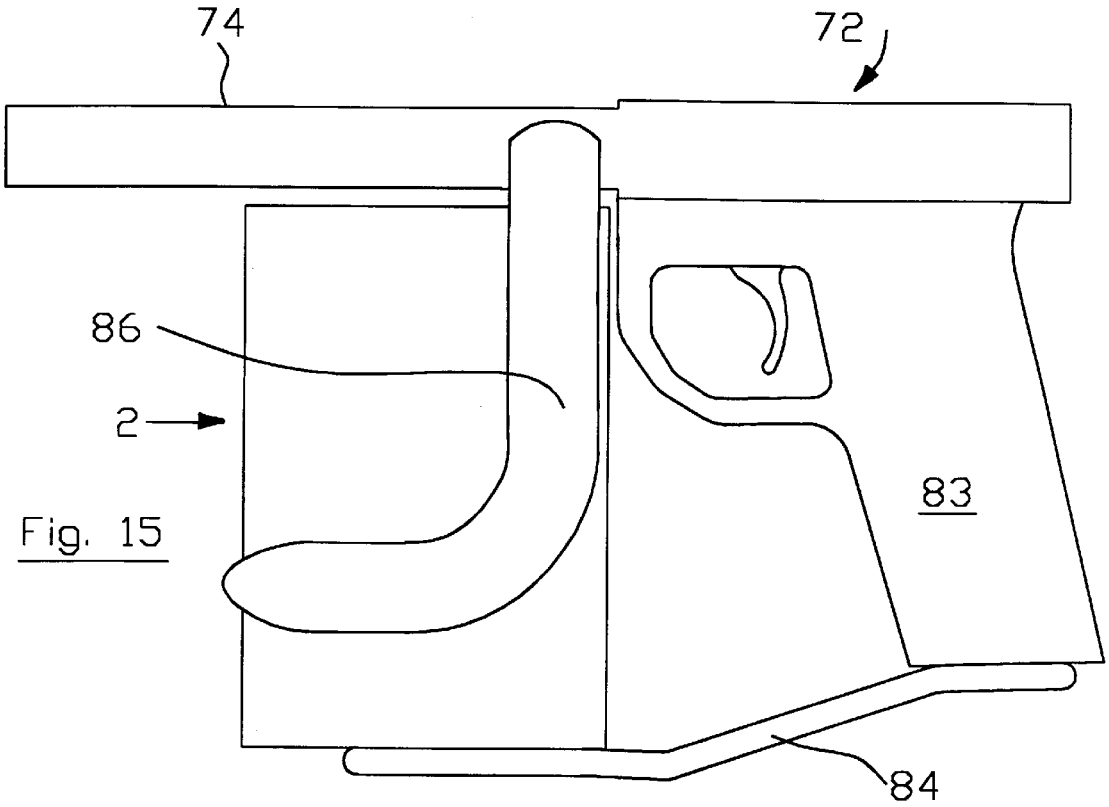
FIGS. 15 and 16 show a side and plan views of apparatus according to the present invention attached to a paint ball gun.
Figure 16:
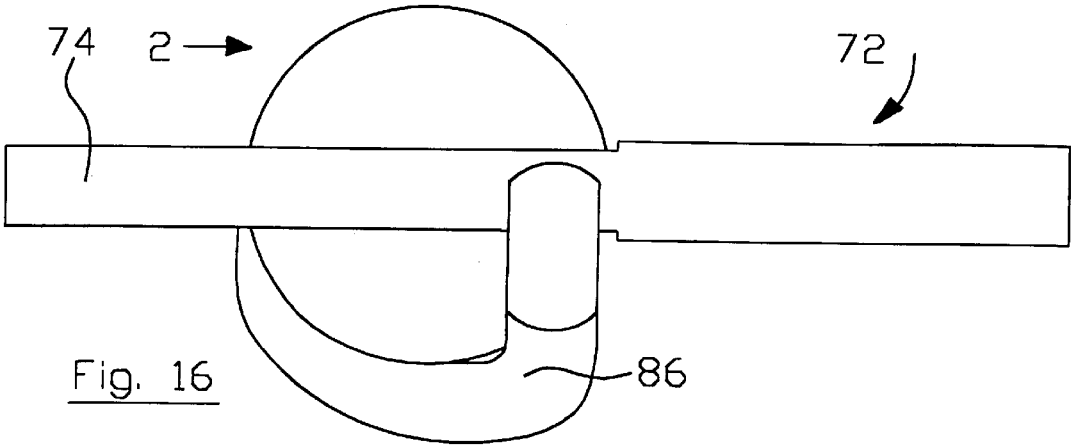

FIGS. 15 and 16 show a diagrammatic representation of an apparatus 2 according to the present invention attached to a paint ball gun 72. The apparatus 2 is positioned below the barrel 74 and is connected to a hand grip 83 of the gun 72 by a bracket 84. A feed tube 86 extends from the outlet 8 to the breech inlet port 78. This configuration does not suffer from the aforementioned disadvantage associated with conventional gravity feed systems wherein a hopper is positioned above the barrel 74.

Figure 17:
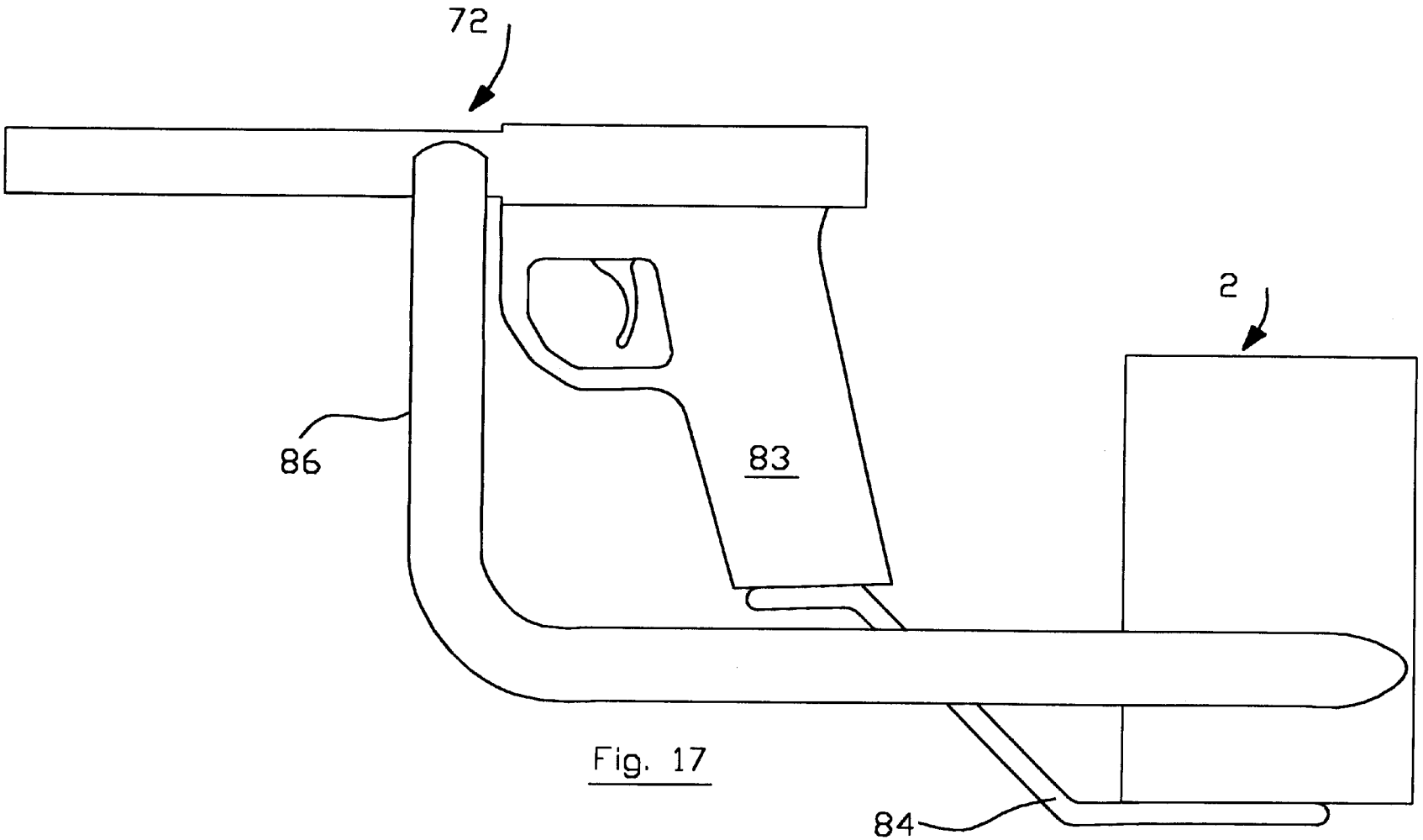
FIG. 17 shows an alternative attachment position for the apparatus.
Figure 18:
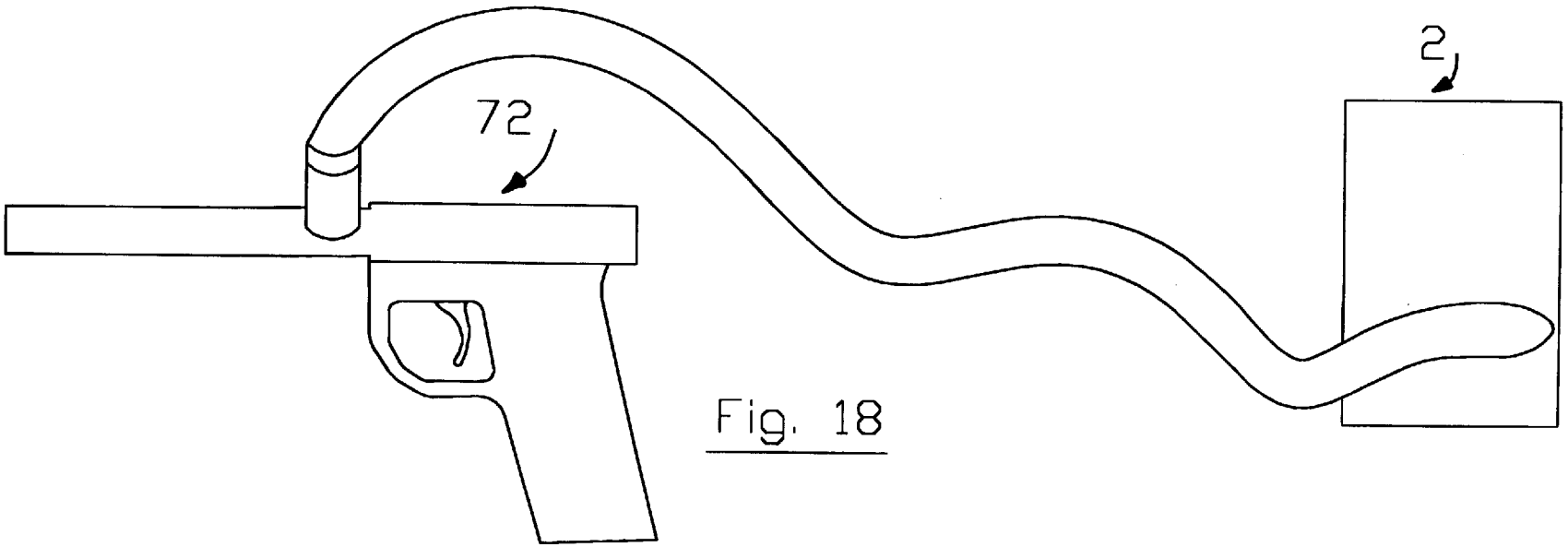
FIG. 18 shows a diagrammatic view of apparatus according to the present invention feeding a gun from a remote location.

FIG. 17 shows an alternative embodiment wherein the apparatus 2 is provided on a bracket 84 which extends rearwardly from the hand grip 82. In such an embodiment the apparatus 2 could be incorporated into, or form part of, a stock of the gun 72. FIG. 18 shows a further embodiment wherein the apparatus 2 is not rigidly connected to the gun 72. Here, a flexible hose 88 extends from the outlet 8 to the breech inlet port 78. In this embodiment the apparatus 2 may be sited at a location remote from the gun 72, for example being carried by a harness or belt worn by a user.

The apparatus described above is about to deliver paint balls to the breech of a paint ball gun from above, below or to the side of the breech. As the apparatus does not rely on the force of gravity to supply paint balls to the breech it does not have to be positioned above the breech inlet, and there exists considerable freedom in choosing the position where the apparatus is to be located. By attaching the apparatus below the barrel, the overall height of the gun system is reduced and the target presented by a conventional hopper is eliminated. An attachment position below the barrel also improves the weight distribution of the gun system. As noted above the apparatus can be positioned remote from the breech inlet port either in the tail stock of a gun or at point on the body of a user.

The rate of delivery of the paint balls and their exit speed through the outlet of the apparatus is related to the rotational speed of the carrier disc. The apparatus may include a control, such as a dash pot, to alter the rotational speed of the carrier disc to allow the apparatus to be synchronised with the firing characteristics of a particular gun. Alternatively the apparatus may be controllable by a control system as will be described below.

Figure 19:
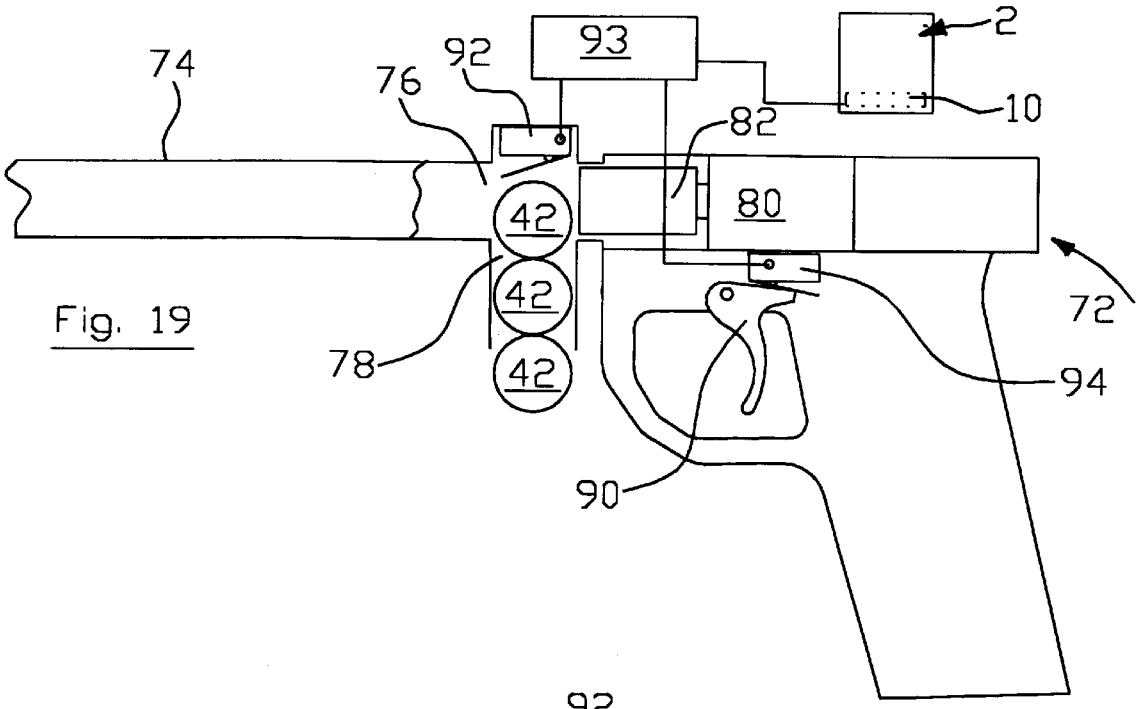
FIGS. 19 and 20 show diagrammatic representations of a synchronisation system according to an aspect of the present invention.
Figure 20:
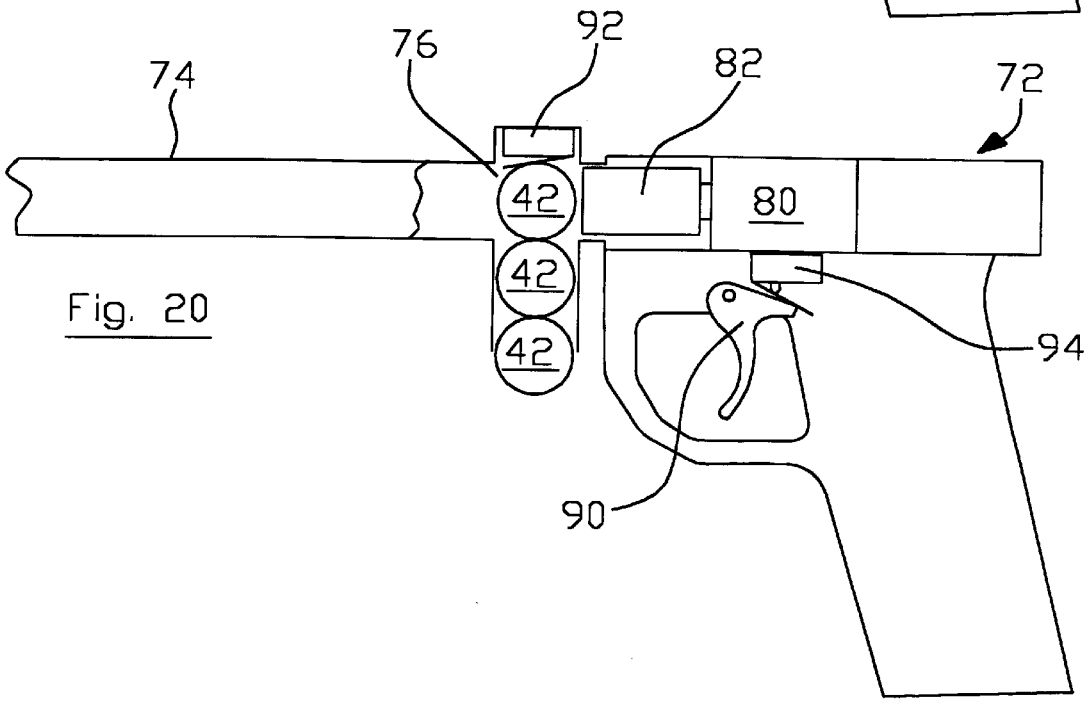

FIGS. 19 and 20 show a diagrammatic representation of a control lysate to control the firing action of a paint ball gun 72. The gun 72 comprises a barrel 74, a breech 76 having an inlet port 78, a firing mechanism 80 including a bolt 82, and a trigger mechanism 90. The breech 76 and trigger mechanism 90 include sensors in the form of micro switches 92,94 to sense respectively the presence of a paint ball 42 in the breech 76, and the condition of the trigger mechanism 90. In FIG. 19 a paint ball 42 is shown only partially within the breech 76 and accordingly the breech micro switch 92 is not depressed. A control circuit 93 associated with the micro switches 92,94 will detect that the breech 76 is either empty or not correctly loaded and will prevent the firing mechanism 80 from operating, even when the trigger mechanism 90 is squeezed as shown in FIG. 15. The control circuit 93 may also control the motor 10 of the apparatus 2 such that when it is detected that the breech is either empty or not correctly loaded, the apparatus is operated to supply a paint ball 42 fully into the breech 76. FIG. 20 shows the condition wherein a paint ball 42 is correctly positioned in the breech 76 and the micro switch is depressed. The control means will thus permit the firing mechanism 80 to operate when the trigger mechanism 90 is operated.

What is claimed is:

1. Apparatus for storing and dispensing spherical projectiles, comprising a chamber having an inlet and an outlet, a carrier mounted in the chamber, the carrier defining a plurality of pockets around its periphery and each pocket being capable of receiving from a lower portion of the chamber and supporting from beneath a spherical projectile fed by gravity from an upper portion of the chamber, the apparatus further comprising guide means to urge respective spherical projectiles from the pockets and into the outlet as a result of relative rotary movement between the carrier and the guide means.

2. Apparatus according to claim 1 wherein the outlet is positioned substantially tangentially with respect to the carrier.

3. Apparatus according to claim 2 wherein the carrier is mounted in the chamber for rotation by drive means relative to the guide means.

4. Apparatus according to claim 3 wherein the guide means comprises a guide bar positioned adjacent the carrier and adjacent the outlet.

5. Apparatus according to claim 4 wherein the guide means includes a guide member surmounting the guide bar.

6. Apparatus according to claim 5 wherein the guide member is a plate.

7. Apparatus according to claim 4, wherein the guide bar includes a guiding surface which extends from a position in which the guiding surface can make contact with a spherical projectile retained in one of the pockets, to a position where the guiding surface guides the spherical projectile towards the outlet.

8. Apparatus according to claim 7 wherein the guiding surface curves towards the outlet.

9. Apparatus according to claim 3 wherein the drive means comprises a motor.

10. Apparatus according to claim 3 wherein the drive means is reversible.

11. Apparatus according to claim 3 and including an alignment member defining a plurality of guide openings.

12. Apparatus according to claim 11 wherein the alignment member is coupled for rotation with the carrier.

13. Apparatus according to claim 11 wherein the guide openings are recesses.

14. Apparatus according to claim 11 wherein the guide openings are aligned directly above the pockets.

15. Apparatus according to claim 11 wherein the guide openings are positioned above and ahead of the pockets in the direction of rotation of the carrier.

16. Apparatus according to claim 1 wherein the pockets are arranged in a radial array around the carrier.

17. Apparatus according to claim 1 wherein the pockets are symmetrical.

18. Apparatus according to claim 1 wherein the pockets are at least partially contoured so as to conform to the shape of the spherical projectiles.

19. Apparatus according to claim 1 wherein the chamber is provided with one or more baffles.

20. Apparatus according to claim 1 including sensor means for sensing the presence of a spherical projectile at a position between the outlet and a projectile delivery point.

21. Apparatus according to claim 20 wherein the sensor means are positioned in a breech of a spherical projectile gun.

22. Apparatus according to claim 20 including control means to control the firing action of a spherical projectile gun, the control means being operable to prevent the firing action of the gun unless a spherical projectile is sensed to be in a correct position by the sensing means.

23. Apparatus for storing and dispensing spherical projectiles comprising a chamber having an inlet and an outlet, a carrier mounted in the chamber, the carrier defining a plurality of pockets around its periphery and each pocket being capable of receiving from a lower portion of the chamber a spherical projectile fed by gravity from an upper portion of the chamber, the apparatus further comprising guide means to urge respective spherical projectiles from the pockets and into the outlet as a result of relative rotary movement between the carrier and the guide means, wherein the guide means are adapted to limit movement of spherical projectiles in contact therewith in a direction substantially parallel to the axis of rotation.

24. Apparatus according to claim 23 wherein the guide means comprises a guide bar positioned adjacent the carrier and adjacent the outlet.

25. Apparatus according to claim 24 wherein the guide means includes a guide member surmounting the guide bar.

26. Apparatus according to claim 25 wherein the guide member is a plate.

27. Apparatus according to claim 23 wherein the guide means includes a guiding surface which extends form a position in which it makes contact with a spherical projectile retained in one of the pockets, to a position where it guides the spherical projectile towards or into the outlet.

28. Apparatus according to claim 27 wherein the guiding surface curves towards the outlet.

29. Apparatus according to claim 23 including sensor means for sensing the presence of a spherical projectile at a position between the outlet and a projectile delivery point.

30. Apparatus according to claim 29 wherein the sensor means are positioned in a breech of a spherical projectile gun.

31. Apparatus according to claim 30 including control means to control the firing action of a spherical projectile gun, the control means being operable to prevent the firing action of the gun unless a spherical projectile is sensed to be in a correct position by the sensing means.

32. Apparatus for storing and dispensing spherical projectiles comprising a chamber having an inlet and an outlet, a carrier mounted in the chamber, the carrier being capable of receiving spherical projectiles fed by gravity from an upper portion of the chamber, the apparatus further comprising guide means to urge respective spherical projectiles form the carrier and into the outlet as a result of relative rotary movement between the carrier and the guide means, wherein the guide means are adapted to limit movement of spherical projectiles in contact therewith in a direction substantially parallel to the axis of rotation.

33. Apparatus according to claim 32 wherein the guide means comprises a guide bar positioned adjacent the carrier and adjacent the outlet.

34. Apparatus according to claim 33 wherein the guide means includes a guide member surmounting the guide bar.

35. Apparatus according to claim 34 wherein the guide member is a plate.

36. Apparatus according to claim 32 wherein the guide means includes a guiding surface which extends form a position in which it makes contact with a spherical projectile carried by the carrier, to a position where it guides the spherical projectile towards or into the outlet.

37. Apparatus according to claim 36 wherein the guiding surface curves towards the outlet.

38. Apparatus according to claim 33 in which the guide means includes a guide member above the guide bar.

39. Apparatus according to claim 38 in which the guide member is a plate.

40. Apparatus according to claim 32 including sensor means for sensing the presence of a spherical projectile at a position between the outlet and a projectile delivery point.

41. Apparatus according to claim 40 wherein the sensor means are positioned in a breech of a spherical projectile gun.

42. Apparatus according to claim 41 including control means to control the firing action of a spherical projectile gun, the control means being operable to prevent the firing action of the gun unless a spherical projectile is sensed to be in a correct position by the sensing means.

43. Apparatus for storing and dispensing spherical projectiles comprising a chamber having an inlet and an outlet, a carrier mounted in the chamber, the carrier being capable of receiving from a lower portion of the chamber spherical projectiles fed by gravity from an upper portion of the chamber, the apparatus further comprising guide means to urge respective spherical projectiles form the carrier and into the outlet as a result of relative rotary movement between the carrier and the guide means, wherein an alignment member is provided above the carrier, the alignment member serving to align the sphericl projectiles with respect to the carrier.

44. Apparatus according to claim 43 wherein the alignment member defines a plurality of guide openings.

45. Apparatus according to claim 44 wherein the guide openings are recesses.

46. Apparatus according to claim 43 wherein the alignment member is coupled for rotation with the carrier.

47. Apparatus according to claim 43 wherein the guide means is provided between the carrier and the alignment member.

48. Apparatus according to claim 43 including sensor means for sensing the presence of a spherical projectile at a position between the outlet and a projectile delivery point.

49. Apparatus according to claim 48 wherein the sensor means are positioned in a breech of a spherical projectile gun.

50. Apparatus according to claim 49 including control means to control the firing action of a spherical projectile gun, the control means being operable to prevent the firing action of the gun unless a spherical projectile is sensed to be in a correct position by the sensing means.

51. Apparatus for storing and dispensing spherical projectiles comprising a chamber having an inlet and an outlet, a carrier mounted in the chamber, the carrier being capable of receiving from a lower portion of the chamber spherical projectiles fed by gravity from an upper portion of the chamber, the apparatus further comprising guide means to urge respective spherical projectiles form the carrier and into the outlet as a result of relative rotary movement between the carrier and the guide means, and a feed tube to which the spherical projectiles are fed by the carrier, the feed tube being arranged to convey the spherical projectiles to a delivery point.

52. Apparatus according to claim 51 wherein the guide means comprises a guide bar positioned adjacent the carrier and adjacent the outlet.

53. Apparatus according to claim 52 wherein the guide means includes a guide member surmounting the guide bar.

54. Apparatus according to claim 53 wherein the guide member is a plate.

55. Apparatus according to claim 51 wherein the guide means includes a guiding surface which extends from a position in which it makes contact with a spherical projectile carried by the carrier, to a position where it guides the spherical projectile towards or into the outlet.

56. Apparatus according to claim 55 wherein the guiding surface curves towards the outlet.

57. Apparatus according to claim 52 in which the guide means includes a guide member above the guide bar.

58. Apparatus according to claim 57 in which the guide member is a plate.

59. Apparatus according to claim 51 including sensor means for sensing the presence of a spherical projectile at a position between the outlet and a projectile delivery point.

60. Apparatus according to claim 59 wherein the sensor means are positioned in a breech of a spherical projectile gun.

61. Apparatus according to claim 59 including control means to control the firing action of a spherical projectile gun, the control means being operable to prevent the firing action of the gun unless a spherical projectile is sensed to be in a correct position by the sensing means.

62. Apparatus according to claim 51 wherein the guide means are adapted to limit movement of spherical projectiles in contact therewith in a direction substantially parallel to the axis of rotation.

* * * * *